US006325308B1

(12) United States Patent
Lofgren et al.

(10) Patent No.: US 6,325,308 B1
(45) Date of Patent: Dec. 4, 2001

(54) REFINER DISC AND METHOD

(75) Inventors: Mattias Lofgren, Yxlan (SE); Christopher M. Holland, Waukesha, WI (US)

(73) Assignee: J & L Fiber Services, Inc., Waukesha, WI (US)

( * ) Notice: Subject to any disclaimer, the term of this patent is extended or adjusted under 35 U.S.C. 154(b) by 0 days.

(21) Appl. No.: 09/406,900

(22) Filed: Sep. 28, 1999

(51) Int. Cl.[7] ..... B02C 7/12

(52) U.S. Cl. ..... 241/28; 241/261.3; 241/298

(58) Field of Search ..... 241/261.2, 261.3, 241/296, 297, 298, 28

(56) References Cited

U.S. PATENT DOCUMENTS

| | | |
|---|---|---|
| 1,744,226 | 1/1930 | Hussey . |
| 2,776,800 | 1/1957 | Uschmann . |
| 3,040,997 | 6/1962 | Borden . |
| 3,149,792 | 9/1964 | Textor . |
| 3,910,511 | 10/1975 | Leider et al. . |
| 4,023,739 | 5/1977 | Lampe et al. . |
| 4,036,443 | 7/1977 | Saltarelli . |
| 4,039,154 | 8/1977 | Peterson . |

(List continued on next page.)

FOREIGN PATENT DOCUMENTS

| | | |
|---|---|---|
| 35468 | 5/1951 | (PL) . |
| 1390-281 | 4/1988 | (SU) . |

OTHER PUBLICATIONS

J & L Services Technical Group, "Advances in Uni–Directional Plate Design Increase Throughput and Safeguard Pulp Quality," *Optima Technical Bulletin*, J & L Fiber Services, 1998.

65YHP.108, 65" Jylha (SD56) Refiner Plate, May 26, 1995.

68YHP.112, 65" Jylha (SD56) Refiner Plate, Aug. 20, 1996.

36S2..123, 36–2 Sprout Waldron Refiner Plate, Jul. 13, 1995.

36S1..111, 36–1B or 36–1CP Sprout Waldron Refiner Plate, Feb. 19, 1993.

36S1..112, 36–1B or 36–1CP Sprout Waldron Refiner Plate, Feb. 19, 1993.

36S1..117, Sprout 36" 36–1B, 36–1CP Refiner Plate, Jul. 26, 1993.

(List continued on next page.)

*Primary Examiner*—Mark Rosenbaum
(74) *Attorney, Agent, or Firm*—Boyle Frederickson Newholm Stein & Gratz S.C.

(57) ABSTRACT

A refiner disc and segment for a rotary disc fiber refiner which has a plurality of radial fields each having an angular extent no greater than 30° and preferably no greater than 22° for reducing the amplitude and duration of load swings that take place during pumping and holdback cycles. Each field has a refining zone with a refiner groove and a refiner bar and a second zone disposed radially outwardly of the refining zone that changes the direction of flow of stock to reduce stock flow momentum and magnitude of the load swings. Each field can have a third zone radially outward of the second zone that further changes the direction of flow of stock and an infeed zone radially inwardly of the refining zone. If desired, a zone that includes a breaker bar can be disposed radially inwardly of the infeed zone. Where the disc is segmented, the segment has at least three fields. In one preferred embodiment, the segment has at least four fields which reduces the duration and magnitude of load swings by at least 40% thereby reducing refiner vibration and wear while advantageously increasing consistency of pulp quality and throughput. The disc and segment are capable of bi-directional operation without loss of efficiency, quality, and throughput.

56 Claims, 6 Drawing Sheets

U.S. PATENT DOCUMENTS

| | | |
|---|---|---|
| 4,081,147 | 3/1978 | Seifert et al. . |
| 4,171,101 | 10/1979 | Seifert et al. . |
| 4,253,613 | 3/1981 | Reinhall . |
| 4,355,768 | 10/1982 | Johansson . |
| 4,423,845 | 1/1984 | Frazier et al. . |
| 4,635,864 | 1/1987 | Peterson et al. . |
| 4,667,888 | 5/1987 | Andersen . |
| 4,712,745 | 12/1987 | Leith . |
| 4,772,358 | 9/1988 | Virving . |
| 4,813,621 | 3/1989 | Kleinhans . |
| 4,953,796 | 9/1990 | Viving . |
| 5,112,443 | 5/1992 | Viving et al. . |
| 5,181,664 | 1/1993 | Kohler . |
| 5,200,038 | 4/1993 | Brown . |
| 5,248,099 | 9/1993 | Lahner et al. . |
| 5,335,865 | 8/1994 | Kohler et al. . |
| 5,362,003 | 11/1994 | Virving . |
| 5,383,617 | 1/1995 | Deuchars . |
| 5,395,057 | 3/1995 | Williams, Jr. et al. . |
| 5,439,183 | 8/1995 | Virving . |
| 5,683,048 | 11/1997 | Virving . |
| 5,695,136 | 12/1997 | Rohdén et al. . |
| 5,823,453 | 10/1998 | Garasimowicz . |

OTHER PUBLICATIONS

42SW..105, 42–1B or 42–1CP Sprout Waldron Refiner Plate, Nov. 24, 1993.
50SB..104, Twin 48 Sprout Waldron Refiner Plate, Feb. 19, 1993.
36B...144, 36" Bauer Refiner Plate, Jun. 7, 1994.
40B...131, 40" Bauer Counter Rotating Refiner Plate, Jan. 6, 1994.
52B...117, 52" Bauer Refiner Plate, Feb. 19, 1993.
55B.AT164, 52" Bauer Refiner Plate, Dec. 18, 1996.
55BLAT164, 52" Bauer Refiner Plate, Dec. 16, 1996.
59BAPT106, 56" Bauer Refiner Plate, Feb. 3, 1993.
59BAPT127,56" Bauer Refiner Plate, Feb. 28, 1995.
36JS..103, 36" Jones Single Disk Refiner Plate, Jul. 14, 1993.
42JS..102. 42" Jones Single Disk Refiner Plate, Jul. 7, 1993.
42JV..103, 42" Jones Vertifiner/Unimount Refiner Plate, Feb. 19, 1993.
36ADL.112, 36" Defibrator, L36 or L32 Refiner Plate, Feb. 19, 1993.
42ADL.166, 42" Defibrator, (L–42) Refiner Plate, Sep. 3, 1996.
44ADL.165, 42" Defibrator, (L–42) Refiner Plate, May 9, 1996.
46ADLQ124, 42" Defibrator, (L42) Refiner Plate, Feb. 19, 1993.
46SDW.107, 46" Defibrator, (L–46) Refiner Plate, Oct. 6, 1993.
54SD..121, 50/54" Defibrator, (RGP50/54) Refiner Plate, Oct. 12, 1994.
54SD..123, 50/54" Defibrator, (RGP50/54) Refiner Plate, Dec. 23, 1994.
54SD..125, 50/54" Defibrator, (RGP50/54) Refiner Plate, Sep. 11, 1996.
54SM..101, RGP 254 (M54) Refiner Plate, Jan. 16, 1996.
59ADP.123, RLP 54/58" Defibrator Refiner Plate, Jul. 22, 1996.
60SDP.104, RGP 60/65 DD Refiner Plate, Mar. 5, 1996.
65ADP.101, Sunds RG60/65 Refiner Plate, Oct. 16, 1995.
49EN..101, 49" Enso Refiner Plate, Feb. 19, 1993.
58YMP.101, 58" Hymac Refiner Plate, Feb. 19, 1993.
60YMP.102, 54" Jylha Modified by Hymac Refiner Plate, Feb. 19, 1993.
62YHP.122, 62" Jylhavaara (SD 60) Refiner Plate, May 3, 1995.
64YMP.101, 64" Hymac Refiner Plate, Feb. 19, 1993.
68YMP.103, 68" Hymac Refiner Plate, Nov. 12, 1996.
20TF..144, 20" Twin–Flo or Black Clawson Refiner Plate, Apr, 12, 1993.
34TF..159, 34" Twin–Flo or Black Clawson Refiner Plate, Aug. 23, 1993 and 34TF..166 34" Twin–Flo or BC Refiner Plate, Feb. 8, 1993.
34TF..156, 34" Twin–Flo Refiner Plate, Aug. 23, 1993 and 34TF..161, 34" Twin–Flo Refiner Plate, Feb. 8, 1993.
34TF..174, 34" Twin–Flo or Black Clawson Refiner Plate, Apr. 12, 1994 and 34TF..176, 34" Twin–Flo or Black Clawson Refiner Plate, May 31, 1994.
34TF..184, 34" Sprout Waldron Refiner Plate, Feb. 8, 1996 and 34TF..186, 34" Sprout Waldron Refiner Plate, Sep. 10, 1996.
36TF..178, 34" Twin–Flo or Black Clawson Refiner Plate, Feb. 7, 1995.
44SU..100, 42" or 48" Sutherland Refiner Plate, Feb. 8, 1993 and 44SU..106, 44" Sutherland Refiner Plate, Oct. 6, 1994.
20VH..100, OSDM Refiner Plate, Jul. 26, 1994 and 20VH..102; Voith OSDM Refiner Plate, Jul. 26, 1994.
50YH..100, Jylhavaara Refiner Plate, Feb. 19, 1993.
50YH..103, SD–48 Refiner Plate, Aug. 7, 1996.
50YH..104, SD–48 Refiner Plate, Aug. 7, 1996.
52YHP.100, 52" Jylha Refiner Plate, Feb. 19, 1993.
52YHP.101, 52" Jylha (SD52) Refiner Plate, Aug. 31, 1992.
52YHP.103, 52" Jylha (SD52) Refiner Plate, Apr. 4, 1995.
54YHU.102, 54" Jylhavaara Refiner Plate, Feb. 19, 1993.
62YHP.121, 60" Jylhavaara or Hymac Refiner Plate, Nov. 1, 1994.
62YHP.122, 62" Jylhavaara (SD 60) Refiner Plate, May 3, 1995.
63YHP.124, 62" Jylhavaara (SD 62) Refiner Plate, Feb. 4, 1997.

REFINER DISC AND METHOD

FIELD OF THE INVENTION

This invention relates to refiners which prepare fibers for use in paper-based products including papermaking, to rotary disc refiners in particular, and to a refiner disc and method of refining using a refiner disc that is capable of bi-directional operation.

BACKGROUND OF THE INVENTION

For papermaking purposes, wood chips, or another fiber source, are ground into smaller chips, or mechanically treated, so that the chips may be broken down further and refined preferably into individual fibers. After refining, these individual fibers are used to make paper or paper-related products, such as paper cups, paper plates, toilet paper, paper towels, diapers, and other products that can be absorbent.

Disc refiners are used to break down clumps of fibers into individual fibers. A disc refiner typically utilizes pairs of opposed refiner discs. A refiner disc is a disc-shaped steel or steel-alloy casting, which has an array of generally radially extending bars or upraised ridges formed in its refining face or refining surface. The refiner disc may be formed of one or more continuous annular discs, or may instead be formed of a plurality of refiner disc segments arranged to form a ring or annulus.

One refiner disc is mounted on a rotor for rotation and the other disc is mounted on another mounting surface opposed to the first refiner disc such that both discs face each other and are very close to each other. The other mounting surface may, for example, be a mounting surface that does not move during refiner operation or another rotor, which turns in a direction opposite the first rotor. As wood pulp passes between the opposed refiner discs, relative rotation between the opposed discs desirably refines the pulp.

Many commercial refiner discs are unidirectional, that is, designed to be rotated only in one direction, or to be stationary and oppose a refiner disc that is rotated only in one direction. Each upraised bar of each disc has a leading edge on one side, where cutting or fibrillation of the fibers being refined primarily occurs, and a trailing edge on the other side. As a result, the leading edge of each bar wears much more quickly than the trailing edge. When too much wear occurs, pulp quality and efficiency dramatically decrease until the refiner disc must be replaced.

While it might seem logical to simply reverse rotation when the leading bar edges become worn to take advantage of the relatively less worn trailing edges, the bars are angled for rotation in only one direction. When unidirectional discs are reversed, which inevitably happens, refining costs rise because refining quality and efficiency suffer. Significantly more power is required to refine the pulp to the desired pulp quality, if the desired pulp quality can even be achieved. Moreover, rotating a unidirectional disc the wrong direction in secondary or rejects refining applications reduces throughput and efficiency and can destroy fiber strength.

Bi-directional refiner discs are designed to be rotated in either direction with the desired goal of extending disc life. Because they are designed to be rotated in either direction, adjacent radial fields of angled bars are symmetrical and mirrored about a radial line. During typical use, a bi-directional disc is rotated in one direction, or faces another bi-directional disc rotating in one direction, for a certain period of time until the leading edges of the bars become worn. The direction is then reversed causing the much less worn and previously trailing bar edges to become the leading edges.

FIG. 2 depicts a prior art segment of a bi-directional refiner disc that is made up of 4, 6, 8, 10, or 12 of these segments. The segment has two fields, I and II, that each have upraised bars that extend radially outwardly and which are mirrored about a radial line, ML. The bars of each field are acutely inclined relative to the mirror line, ML, at about the same angle with the bars in one of the fields angled in one direction and the bars in the other of the fields angled in another direction. The grooves between the bars, through which stock being refined flows, are generally straight with some of the grooves split into two generally straight grooves by a shorter bar. Surface and subsurface dams, respectively indicated by the filled and unfilled circles, are located in the grooves to direct stock flow upwardly toward the bar edges to increase the likelihood that fiber in the stock will be ground between bars of the opposing discs.

During operation, stock is introduced radially inwardly of the disc and flows radially outwardly in the gap between the discs. When the grooves of one of the fields of the opposing disc are generally parallel to the grooves in one of the fields, I or II, stock in that region is urged radially outwardly or pumped. Conversely, when the grooves of one of the fields of the opposing disc cross the grooves in one of the fields, I or II, radial flow of stock is opposed or held back. Because the opposing disc has the same groove and bar configuration as the disc it faces, during disc rotation, the fields I and II alternate between pumping and hold back cycles. When a pumping cycle is occurring in field I, a hold back cycle is occurring in field II, and when a hold back cycle is occurring in field I, a pumping cycle is occurring in field II.

While bi-directional refiner discs have enjoyed substantial commercial success, improvements nonetheless remain desirable. The use of only two fields per disc segment means that when a pumping cycle is occurring in a particular field, it occurs for a certain duration of time. During a pumping cycle, stock flows radially outwardly building momentum. Because the grooves are generally straight, momentum greatly builds as the stock reaches the outer radial periphery of the disc because angular acceleration is greatest in this region. When a hold back cycle begins, the radial outward flow of the fiber is drastically disrupted causing a great deal of the momentum of the stock to be absorbed by the refiner. This results in an increasing load, $L_1$ (FIG. 3), on the refiner that has a particular amplitude that builds over time until it reaches amplitude, $P_1$. When another pumping cycle begins, the amplitude of the load reaches a peak, $PK_1$, and then begins to decrease in the manner depicted by $L_1$ as the stock begins flowing once again in a radially outward direction. These momentum changes impart load swings that are significant due to the rather large magnitude, $P_1$ of the load at the time each peak occurs.

These load swings cause vibration that significantly impacts refiner operation. First, the refiner operates less efficiently than desired. Second, pulp quality can undesirably vary. Third, wear is accelerated on the components of the refiner, as well as the refiner disc itself.

In the bi-directional refiner disc shown in FIG. 2, some of the bars extend to the inner peripheral edge of the disc and other bars extend adjacent the edge. Unfortunately, this can impede outward flow of the stock, which can reduce refiner throughput.

To help force the fiber in the stock up into the gap so it gets refined, the refiner disc has over ten rows of dams. Unfortunately, too many dams can obstruct steam flow through the disc. Not only can obstructed steam impede the outward flow of the stock, it can also backflow steam into the stock being fed into the refiner thereby reducing the infeed rate. Moreover, the vibration in combination with obstructed steam can lead to variations in the refining gap, which can further reduce the consistency of pulp quality.

OBJECTS AND SUMMARY OF THE INVENTION

The present invention provides an improved refiner disc that has at least a plurality of radial fields each having a radial extent no greater than about 30° and at least two annularly extending zones where at least some refining takes place. During operation, one disc is rotated relative to an opposed disc for a certain duration of time or until a particular amount of wear has occurred. If desired, rotation can then reversed. If desired, rotation can be reversed one or more times depending on several factors including, for example, the wear on the disc and how long it has rotated in each direction.

In one preferred refiner disc embodiment, the disc is made up of segments each having at least three radial fields. Each radial field can have two or more annularly extending zones with at least one of the zones for refining and another of the zones for redirecting flow of stock.

Each radial field has at least one upraised refiner bar disposed at an acute angle relative to a radial direction that preferably is a radial line that separates adjacent fields. Each radial field can extend from an inner peripheral edge of the segment to an outer peripheral edge of the segment. Each segment preferably has at least four fields that each have an angular extent no greater than 30° and no less than about 2°. In one preferred refiner disc, the disc has at least sixteen fields and can have as many as one hundred and forty-four fields or more.

Each radial field has an annularly extending primary refining zone disposed about the middle of the field. The primary refining zone preferably has at least one refining groove disposed between a pair of upraised refiner bars and can have one or more rows of dams.

Each radial field has a second annularly extending zone disposed radially outwardly of the primary refining zone where the direction of flow of stock being refined is altered. This second zone also has at least one groove disposed between a pair of upraised refiner bars. The groove and refiner bars are disposed at an angle relative to the groove and refiner bars of the primary refining zone to alter the direction of flow of the stock when it passes from the primary refining zone to the second zone. The second zone preferably is a secondary refining zone where further refining of the stock takes place. If desired, the second zone can extend radially from the primary refining zone to the outer radial periphery of the segment.

If desired, the field can have a third annularly extending zone disposed radially outwardly of the second zone. The third zone is disposed between the second zone and the outer periphery. This third zone also has at least one groove disposed between a pair of upraised refiner bars. The groove and refiner bars are disposed at an angle relative to the groove and refiner bars of the second zone to alter the direction of flow of the stock when it passes from the second zone to the third zone. The third zone preferably also is a refining zone where further refining of the stock takes place before it is discharged from the refiner.

If desired, a disc can having more than one second zone. If desired, a disc can have more than one third zone. For example, a disc can have alternating second and third zones located radially outwardly of the primary refining zone.

The field can also have an infeed zone disposed radially inwardly of the primary refining zone. The infeed zone has at least one infeed zone between a pair of upraised infeed bars that are each wider than the refiner bars. The bars of the infeed zone help channel flow of stock toward the primary refining zone.

The field can also have a breaker bar zone containing at least one breaker bar that is wider than an infeed bar. The breaker bar zone is disposed radially inwardly of the infeed zone and preferably is disposed adjacent the inner radial periphery of the disc or segment.

In one refiner disc embodiment, each field has each one of the aforementioned zones, a total of five zones in all. In another refiner disc embodiment, a field has four of the aforementioned zones. The second zone extends radially from the outer radial periphery of the primary refining zone to adjacent the outer radial periphery of the disc or segment. In a still further refiner disc embodiment, the primary refining zone has at least two rows of dams with at least one of the rows being surface dams and at least one other of the rows being subsurface dams. In still another refiner disc embodiment, no dams are employed.

In a method of refining a stock slurry containing fiber, at least one of a pair of opposed refiner discs is rotated relative to the other one of the discs. The stock is introduced into the gap between the discs and flows generally in a radial outward direction. The stock is directed by the groove of the infeed zone toward the primary refining zone where fibers in the stock are at least partially refined. The direction of the flow of stock is changed when the stock leaves the primary refining zone and enters the second refining zone where fiber in the stock is also refined.

Where the refiner disc has a third zone radially outwardly of the second zone, the direction of flow of the stock is altered another time when the stock leaves the second zone and enters the third zone. Fiber in the stock preferably is also refined in the third zone.

Where the refiner disc has a breaker bar zone, stock infeed to the discs is accelerated radially outwardly by each breaker bar.

The refiner disc is rotated in one direction for a duration of time or can face another disc that is rotated in one direction for a duration of time. After that, the direction of rotation can be reversed where it is desired to operate the refiner discs as bi-directional refiner discs. Typically, the direction of rotation can be reversed more than once before replacement is required.

It is an object of the present invention to provide a refiner disc that can be rotated in either direction or be used with another refiner disc that is rotated in either direction substantially without loss in efficiency or pulp quality.

It is another object of the present invention to increase residency time of fiber between refiner discs while permitting steam between the discs to more easily flow out from between the discs.

It is still another object of the present invention to reduce the magnitude of load swings during refiner operation.

It is a further object of the present invention to reduce refiner vibration during operation.

It is a still further object of the present invention to increase the consistency of pulp quality during refiner operation.

It is another object of the present invention to permit the refiner to operate under greater load and throughput than previously achieved in refiners using prior art refiner discs.

It is an advantage of the present invention that the magnitude or amplitude of refiner loads are reduced by at least 40% by using a segmented refiner disc of the invention having at least four fields per segment as compared to a conventional segmented refiner disc of the same angular extent having only two radial fields.

It is another advantage of the present invention that refiner wear and refiner disc wear is reduced by using a refiner disc having radial fields with a maximum angular extent no greater than 30° because vibration and loading is reduced.

It is still another advantage of the present invention that the gap between opposed refiner disc varies less because vibration and load are less and because steam flows more easily from out between the discs.

It is an additional advantage of the present invention that the duration and magnitude of the load swing and associated cycling is reduced by at least 40% and preferably by over half.

Other objects, features, and advantages of the present invention are to provide a refiner disc that can be of segmented construction; which is capable of bi-directional operation; which can easily be mounted and removed; which can be cast along with all fields and bars in a single operation; does not require fabrication; and is rugged, simple, flexible, reliable, and durable, and is of economical manufacture, and is easy to assemble and simple to use.

Additional objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF AT LEAST ONE PREFERRED EMBODIMENT

Figure 1:
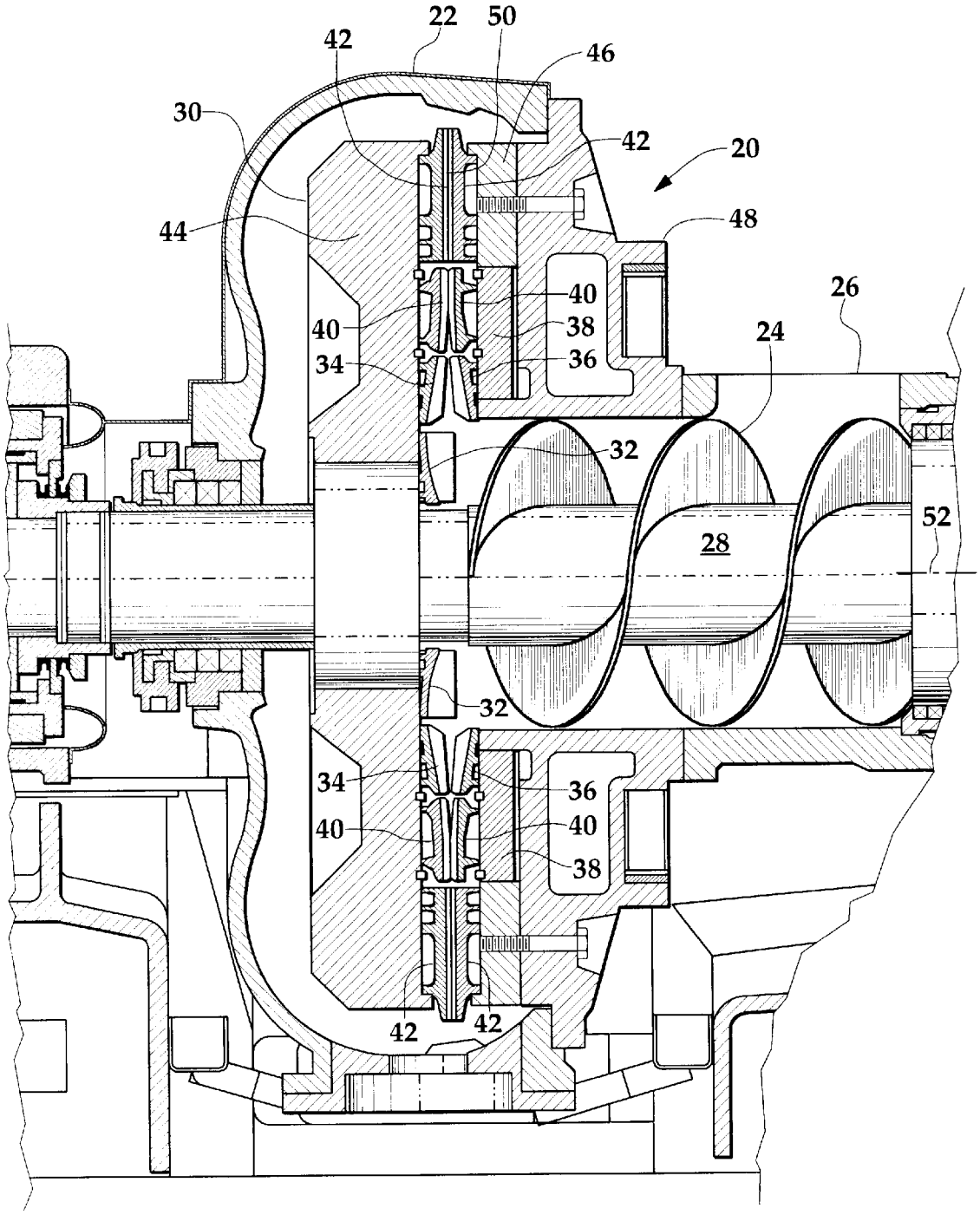
FIG. 1 is a fragmentary cross-sectional view of an exemplary disc refiner having a refiner disc which includes a refiner disc according to the present invention.

An exemplary refiner 20 is shown FIG. 1. The refiner 20 has a housing 22 and an auger 24 mounted therein which urges a stock slurry of liquid and fiber introduced through a stock inlet 26 into the refiner 20. The auger 24 is carried by a shaft 28 that rotates during refiner operation to help supply stock to an arrangement of treating structure within the housing 22 and a rotating rotor 30. An annular flinger nut 32 is generally in line with the auger 24 and directs the stock radially outwardly to a plurality of opposed sets of breaker bar segments 34 and 36.

Each set of breaker bar segments 34 and 36 preferably are in the form of sectors of an annulus, which together form an encircling section of breaker bars. One set of breaker bar segments 34 is fixed to the rotor 30. The other set of breaker bar segments 36 is fixed to another portion of the refiner, such as a stationary mounting surface 38 of the housing 22 or another rotor (not shown).

The breaker bar segments 34 and 36 discharge stock to radially outwardly positioned sets of first refiner discs 40 and second refiner discs 42. The refiner 20 can have more or less than two sets of refiner discs. A first set of the first and second refiner discs 40 and 42 is removably mounted to a mounting surface 44. The mounting surface 44 preferably is the rotor 30. If desired, the mounting surface 44 can be separate from the rotor 30, such as a separate mounting plate (not shown) or another component that is mounted to or carried by the rotor 30 or another component of the refiner 20.

A second set of the first and second refiner discs 40 and 42 is removably mounted to mounting surfaces 38 and 46. The mounting surfaces 38 and 46 can be plates or a common plate that can be carried by a stator 48 supported by the refiner housing 22. If desired, a rotor can be substituted for the stator 48. Such a rotor typically rotates in a direction opposite rotor 30.

The first set of refiner discs 40 and 42 is disposed generally parallel to a radially extending plane 50. The second set of refiner discs 40 and 42 is also disposed generally parallel to the plane 50 and located relative to the first set of discs 40 and 42 such that they oppose the first set. During operation, the rotor 30 and first set of refiner discs 40 and 42 rotate about an axis 52 causing relative rotation between the first set of refiner discs 40 and 42 and the opposed second set of refiner discs 40 and 42. Since disc 40 and disc 42 are both used to refine fiber that preferably is made of wood and thus are substantially similar, only disc 42 will be described in further detail herein.

Figure 4:
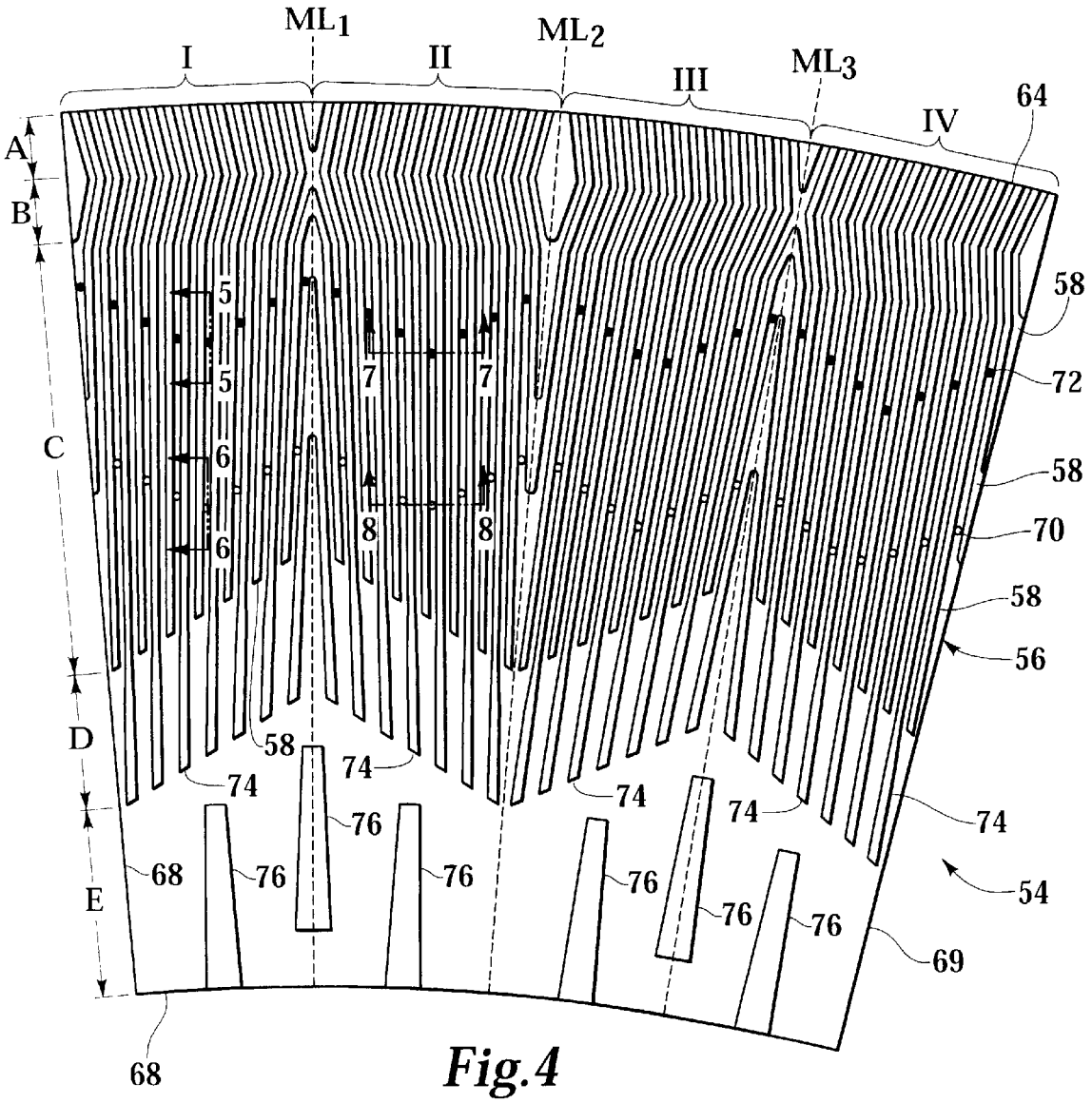
FIG. 4 is a front view of one embodiment of a refiner disc segment of this invention.

Referring to FIG. 4, each refiner disc 42 is a refiner disc comprised of a plurality of refiner disc segments or plates 54 that are arranged in a circle, ring or annulus. Each segment 54 has a refining surface 56 and a rear surface and typically is removably mounted to a mounting surface, such as one of surfaces 38, 44, and 46.

The refiner disc 42 can be made up of four, six, eight, ten, twelve, or even more segments 54. Where four segments 54 are used, each segment 54 encompasses an angular extent of 90°. Where six segments 54 are used, each segment 54 encompasses an angular extent of 60°. Where eight segments 54 are used, each segment 54 encompasses an angular extent of 45°. Where ten segments 54 are used, each segment 54 encompasses an angular extent of 36°. Where twelve segments 54 arc used, each segment 54 encompasses an angular extent of 30°.

A preferred embodiment of a refiner disc segment 54 of this invention is depicted in FIGS. 4–8. The refining surface 56 of each segment 54 has a plurality of pairs of spaced apart ridges or refiner bars 58 that are upraised from a base 60 with the space between each adjacent pair of bars 58 defining a refiner groove 62 therebetween that acts as a flow channel. During refining, stock flows radially outwardly through each channel 62 and over and around each bar 58. Within each channel 62, the segment 54 can have one or more upraised dams, each of which at least partially obstructs stock flow through a channel 62 in a manner that causes stock to flow over the dam and across adjacent bars 58 during refining, preferably to enhance refining action.

Each segment 54 preferably is made of a metal, such as white cast iron or stainless steel, or a metallic material. In one preferred embodiment, the bars 58, grooves 62 and dams (if equipped with dams) of the segment 54 are integrally formed during casting. Where the segment 54 is designed to be mounted using fasteners, holes (not shown) that receive the fasteners can also be formed during casting.

During operation of the refiner 20, stock is processed to free individual fibers, typically wood fibers, in preparation for making paper or another fiber-based product by passing the stock between the opposed sets of first and second refiner discs 40 and 42. The flinger nut 32 has axially upraised radial bars which urge the stock radially outwardly under the centrifugal forces developed by the rotating motion of the rotor 30 and attached flinger nut 32. The breaker bar segments 34 and 36 receive stock discharged radially outwardly from the flinger nut 32, which then passes radially outwardly between the opposed sets of first and second refiner discs 40 and 42.

The refiner disc segment 54 has at least three fields and in the preferred embodiment shown in FIG. 4, has four fields, I, II, III, and IV. Each field is generally pie-shaped but truncated along the inner peripheral edge of the disc. In the preferred embodiment depicted in FIG. 4, each field is defined by a pair of spaced apart radial lines, a curved outer peripheral edge 64, and an inner peripheral edge 66 that preferably also is curved. For example, field I is defined along one side by the side edge 68 of the disc and along its other side by mirror line, $ML_1$. Its inner radial edge is defined by part of the inner peripheral edge 66 of the disc and its outer radial edge is defined by part of the outer peripheral edge 64. The sides of field II are defined by mirror lines, $ML_1$ and $ML_2$, and its outer and inner edges are respectively defined by part of peripheral edges 64 and 66. The sides of field III are defined by mirror lines, $ML_2$ and $ML_3$, and its edges are defined by part of peripheral edges 64 and 66. The sides of field IV are defined by mirror line, $ML_3$ and side edge 69, and its edges are defined by part of peripheral edges 64 and 66.

A refiner disc segment 54 of this invention preferably has between four and twelve fields per segment, but can have more fields, if desired. A refiner disc 42 of this invention therefore preferably has between sixteen fields and one hundred forty-four fields. For example, where the disc 42 is segmented and four segments 54 are used that each have three fields, the refiner disc 42 has twelve fields. Where six segments 54 are used that each have four fields, the refiner disc 42 has twenty-four fields. Where eight segments 54 are used that each have five fields, the refiner disc 42 has forty fields. Where ten segments 54 are used that each have six fields, the refiner disc 42 has sixty fields.

Where each field of a segmented refiner disc 42 encompasses the same angular extent (i.e., is equiangular), the maximum angular extent of each field is no greater than the result from the following relationship $$A_{max}=360^\circ/m*n$$

where $A_{max}$ is the maximum angular extent encompassed by each field;

m is the number of fields per segment; and n is the number of disc segments in the refiner disc.

Where the disc 42 is not segmented, the total number of fields of the disc is substituted into the above equation for the expression m*n. Preferably, the angular extent of ranges between 30° (i.e., a single field encompasses an angle no more than about 30°) and 2°. In another preferred arrangement where there are at least four fields per segment, the angular extent ranges between 20° and 2°. For example, where the disc is made up of six segments 54 that each have four fields, each field has a maximum angular extent of 15°. Where the disc is made up of four segments 54 that each have four fields, each field has a maximum angular extent of 22.5°. Where the disc is made up of six segments 54 that each have four fields, each field has a maximum angular extent of 15°. Where eight segments are used that each have four fields, each field has a maximum angular extent of 11.25°. Where ten segments are used that each have four fields, each field has a maximum angular extent of 9°. Where twelve segments are used that each have four fields, each field has a maximum angular extent of 7.5°.

A segment 54 can have more than four fields. For example, where eight segments 54 are used that each have five fields, each field has a maximum angular extent of 9°. Where ten segments 54 are used that each have six fields, each field has a maximum angular extent of 6°. Preferably, the angular extent of each field is at least 2.5°.

Figure 5:
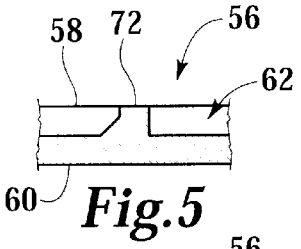
FIG. 5 is a partial fragmentary cross sectional view of a portion of the segment of FIG. 4 taken along lines 5—5.
Figure 7:
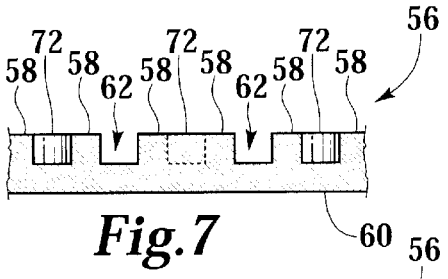
FIG. 7 is a partial fragmentary cross sectional view of a portion of the segment of FIG. 4 taken along 7—7.
Figure 6:
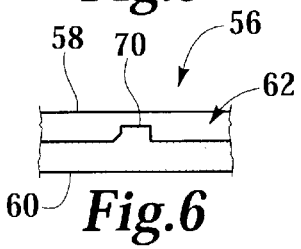
FIG. 6 is a partial fragmentary cross sectional view of a portion of the segment of FIG. 4 taken along lines 6—6.
Figure 8:
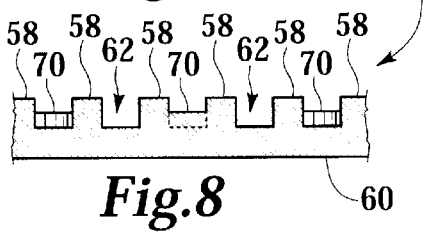
FIG. 8 is a partial fragmentary cross sectional view of a portion of the segment of FIG. 4 taken along lines 8—8.

In one preferred refiner disc embodiment, each field has at least one row of spaced apart dams. For example, the disc segment 54 shown in FIG. 4 has two rows of angularly spaced apart and annularly extending dams with one row of the dams being a row of subsurface dams 70 and another of the rows of the dams being a row of surface dams 72. As is shown in FIGS. 5 and 7, each surface dam 72 is disposed in a groove 62 and extends substantially flush with the top surface of the bars 58 on either side of the dam 72. As is shown in FIGS. 6 and 8, each subsurface dam 70 is disposed in a groove 62 and extends below the top surface of the bars 58 on either side of the dam 70. In another preferred embodiment shown in FIG. 9, the refiner disc 42 has no dams.

Each field has at least one bar 58 that has at least a portion or segment that is acutely angled relative to the mirror line to which it is closest. In a preferred embodiment, each bar 58 of each field has at least one segment or portion disposed at an acute angle relative to the mirror line. Each bar 58 preferably is acutely inclined from radial. Preferably, each bar 59 of each field has at least one segment disposed at an angle greater than 0° and no greater than about 20° relative to the mirror line to which it is closest. In the preferred segment shown in FIG. 4, each field I, II, III, and IV, has at least two bars 58. Each field, I, II, III, and IV, preferably has at least four bars 58 that define at least three grooves 62 therebetween.

Figure 12:
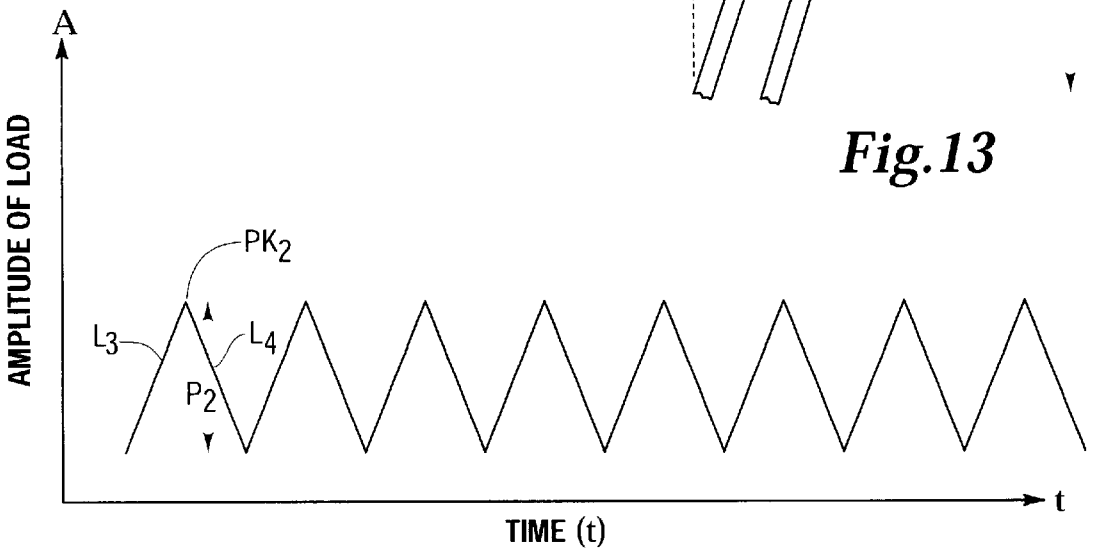
FIG. 12 is a graph of refiner load versus time of refiner operation using a refiner disc of this invention.

The refiner disc segment 54 has at least two annular zones with one of the zones configured to alter at least slightly the direction of flow of the stock. Referring additionally to FIG. 12, this desirably lessens the momentum of the flowing stock which thereby reduces the amplitude or magnitude of the maximum load. As a result of lessening the amplitude of the maximum load, the load swings encountered by the refiner 20 are less forceful, advantageously reducing refiner vibration. By lessening the momentum, residence time of the stock is also increased without requiring as many dams as prior art refiner disc segments. By reducing the number of dams or completely eliminating dams, steam flows more easily through the disc and does not impede flow of stock through the disc. As a result, the gap between the discs is more consistently maintained, increasing the consistency of the pulp quality obtained. Moreover, throughput of the refiner is increased because backflow of steam is virtually if not completely eliminated.

Figure 13:
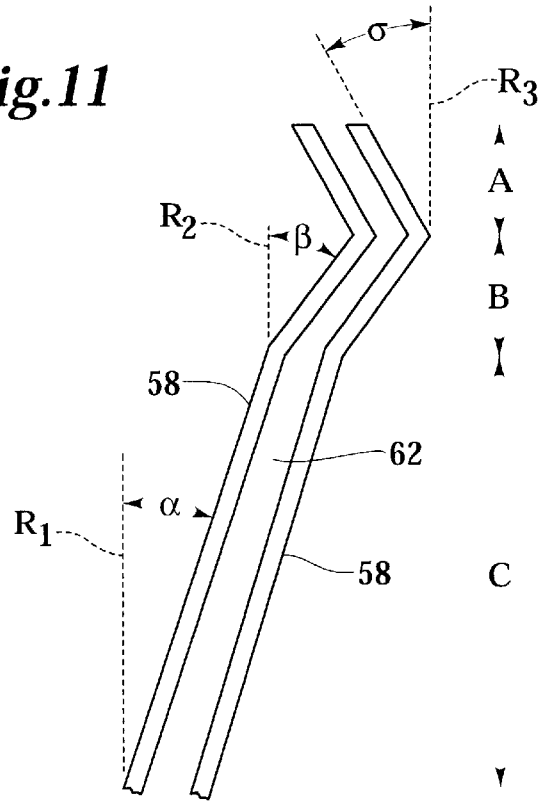
FIG. 13 is an enlarged fragmentary view of a groove and pair of bars of the refiner disc of FIG. 4.

Each field has a primary refining zone, zone C, that extends across the field where refining of fiber in the stock takes place. Referring to FIG. 13, the bars 58 in zone C are generally straight and define an angle, $\alpha$, relative to an adjacent line that extends in a radial direction relative to the disc or segment, such as radial line $R_1$, that is between +20° and −20° and which is greater or less than 0°. In one preferred embodiment, each of the bars in zone C have an angle of at least 2°. In one preferred embodiment, the angle, $\alpha$, is about 2.5°. In one preferred embodiment, zone C has a length in a radial direction that is between one-quarter and three-quarters the radial length of the disc 42 (or segment 54) and can vary in radial length within the same field. The radial length is the distance of that portion of a radial line that extends from the inner edge 66 of the disc 42 to the outer edge 64.

Each field has at least one secondary refining zone disposed radially outwardly of zone C that is configured to direct stock flow at an angle relative to the direction of flow from zone C. In the segment shown in FIG. 4, each field has a pair of zones, zone A and zone B, located radially outwardly of the primary refining zone.

Figure 10:
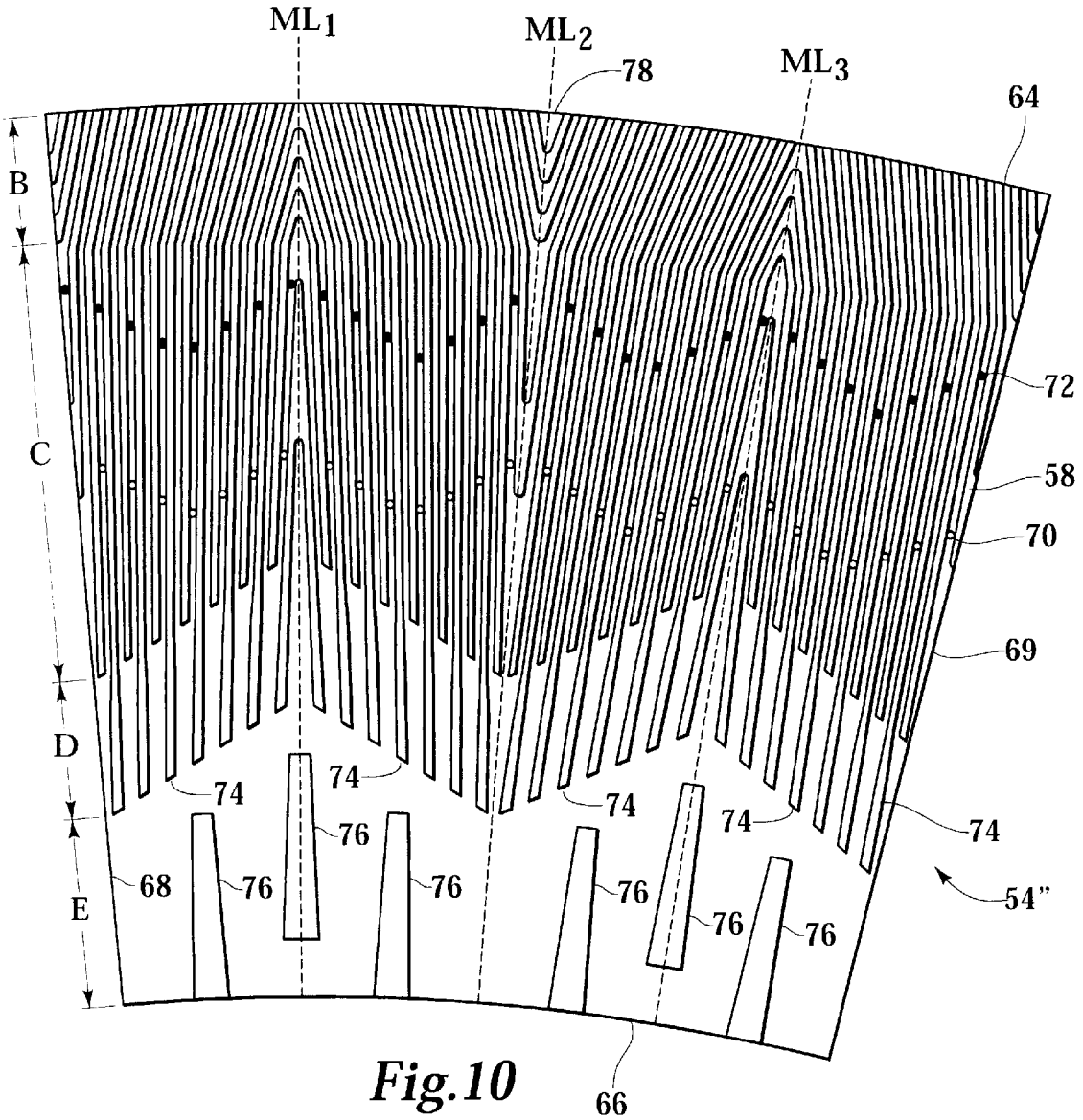
FIG. 10 is a front view of a third embodiment of a refiner disc segment according to the invention.

Zone B is located immediately radially outwardly of zone C. At least a portion of each bar 58 in zone B is disposed at an angle relative to the portion of the bar 58 in zone C. As a result, each groove 62 has a bend where it transitions from zone C to zone B. In the segment shown in FIG. 4, the portion of each bar 58 in zone B is straight and disposed at an angle, $\beta$, of about 15° to 17° relative to a radial line, $R_2$, adjacent that portion of the bar 58. The bar angle can vary. If desired, the bar angle, $\beta$, can be between +45° and −45°. In FIG. 10, zone B extends to the outer peripheral edge 64. No dams preferably are located in zone B. The change of direction in the flow of stock serves the same function as a dam by increasing residency time. However, because zone B has no dams, the steam can flow through the grooves unobstructed. If desired, zone B can be equipped with one or more dams.

Zone A is located immediately radially outwardly of zone B. At least a portion of each bar 58 in zone A is disposed at an angle relative to the portion of the bar 58 in zone B. As a result, each groove 62 has a second bend where it transitions from zone B to zone A. In the segment shown in FIG. 4, the portion of each bar 58 in zone A is straight and disposed at an angle, $\sigma$, of about 30° relative to a radial line, $R_3$, adjacent that portion of the bar 58. The bar angle can vary. If desired, the bar angle can vary between +60° and −60°. In FIG. 10, zone A is lacking. Zone A preferably also has no dams. The change of direction in the flow of stock serves the same function as a dam by increasing residency time. However, because zone A has no dams, the steam can flow through the grooves unobstructed. By increasing the rate of steam flow, pressure pulses are virtually eliminated helping to more accurately maintain the desired gap between opposed discs.

There can be one or more zones disposed radially inwardly of zone C. In the segment shown in FIG. 4, zone D is a feeding zone located immediately adjacent zone C. The feeding zone has at least one bar 74, an infeed bar 74, that narrows in a radial outward direction into a bar 58 of the configuration shown in zone C of FIG. 4. In zone D, each bar 74 is at least about twice as wide as a refiner bar 58 and can become narrower in a radial outward direction. The mouth of each infeed groove between a pair of the bars 74 has a width that is wider than the width of a groove 62 in zone C. Preferably, its width is at least double the width of groove 62 in zone C. Preferably, the bar angle in zone D is the same or substantially the same as the bar angle in zone C. To help facilitate infeed of stock by keeping the inner diameter of the disc more open, the inner radial edge of the closest bar 74 is located no closer than about 0.5 inches (12.7 mm) to the inner edge 66 of the disc 42 or segment 54. Zone D shown in FIG. 4 preferably comprises a parallelogram in shape. If desired, the infeed bars 74 can extend to the inner peripheral edge 66.

Zone E is a section of breaker bars 76 located radially inwardly of zone C. Zone E preferably is located radially inwardly of zone D and comprises at least one breaker bar 76. The breaker bars 76 can be radially staggered across the disc 42 or segment 54. Each breaker bar 76 preferably has a trapezoidal shape and has a longitudinal axis that extends in a radial direction. If desired, the bar 76 can be curved instead of trapezoidal. Each breaker bar 76 preferably is at least twice as wide as an infeed bar 74.

There is at least one generally triangular upraised pad or recessed 78 disposed in line with one of the mirror lines in each disc segment 54. Where the refiner disc 42 is not segmented, there is a triangular pocket/pad 78 in line with every other mirror line. For example, referring to FIG. 10, there is one such pocket/pad 78 disposed in line with mirror line, $ML_2$. Where a pocket 78 is used, it advantageously helps facilitate venting of steam. Where a pad 78 is used, it helps slow the outwardly flow of fibers in the stock. Slowing outward fiber movement advantageously increases fibrillation. Depending on the height and configuration of the pad 78, one or more pads 78 can be used to help resist clashing of opposed refiner discs. Each triangular pocket/pad 78 has a length and width dependent on the geometry and angles of the bars of the disc or segment.

Figure 9:
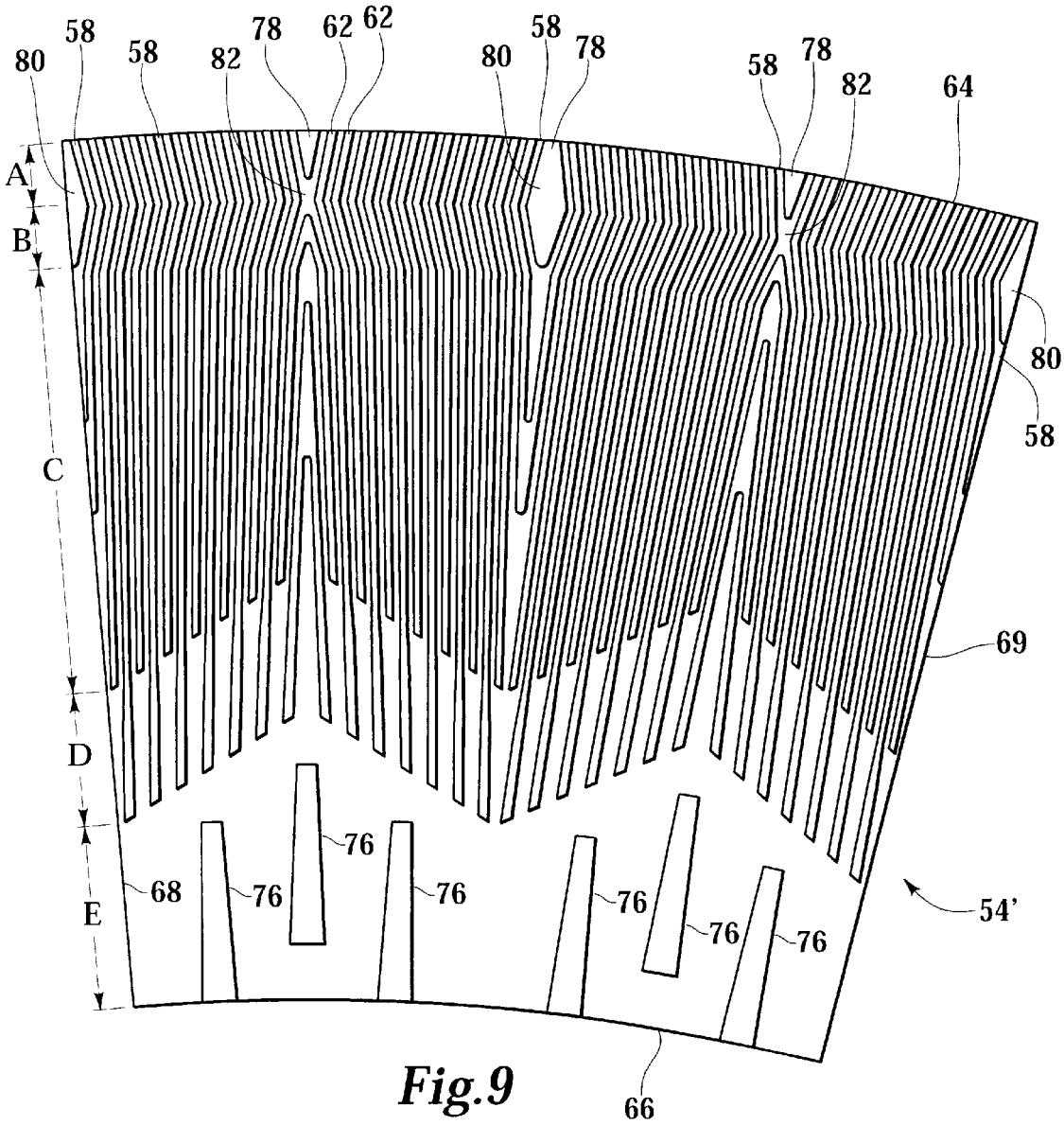
FIG. 9 is a front view of a second embodiment of a refiner disc segment according to the invention.

In one preferred embodiment, shown in FIGS. 4 and 9, the pocket/pad 78 is comprised of back-to-back triangles and forms a chevron-shaped or diamond-shaped pocket/pad 80 that can have one end truncated along the peripheral edge 64 in the manner depicted. If desired, the pocket/pad 80 need not be truncated. This truncated chevron-shaped pocket/pad 80 is disposed in line with every other mirror line. For example, referring to FIG. 4, the chevron-shaped pocket 80 is disposed in line with mirror line $ML_2$. In the preferred embodiments shown in FIGS. 4 and 9, there is also a triangular pocket/pad 78 that is not chevron-shaped disposed in line with the mirror line on either side of mirror line, $ML_2$ and on either side of the chevron-shaped pocket/pad 80. This chevron-shaped pocket 80 is larger in size than each of the other triangular pockets/pads 78 and also facilitates steam flow while slowing outward fiber movement. For those discs 42 or segments 54 equipped with chevron shaped pockets/pads 80, the non-chevron shaped triangular pockets/pads 78 preferably are defined, at least in part, by an X-shaped bar or groove 82 (depending on whether it is adjacent a pocket or a pad) radially inwardly of the non-chevron-shaped triangular pocket/pad 78. Where the X-shaped bar/groove 82 is a bar, it serves as a surface dam by forcing fiber in an axial direction into the gap where it is refined. Where the X-shaped bar/groove 82 is a groove, it helps facilitate flow of steam around the adjacent pad.

Figure 11:
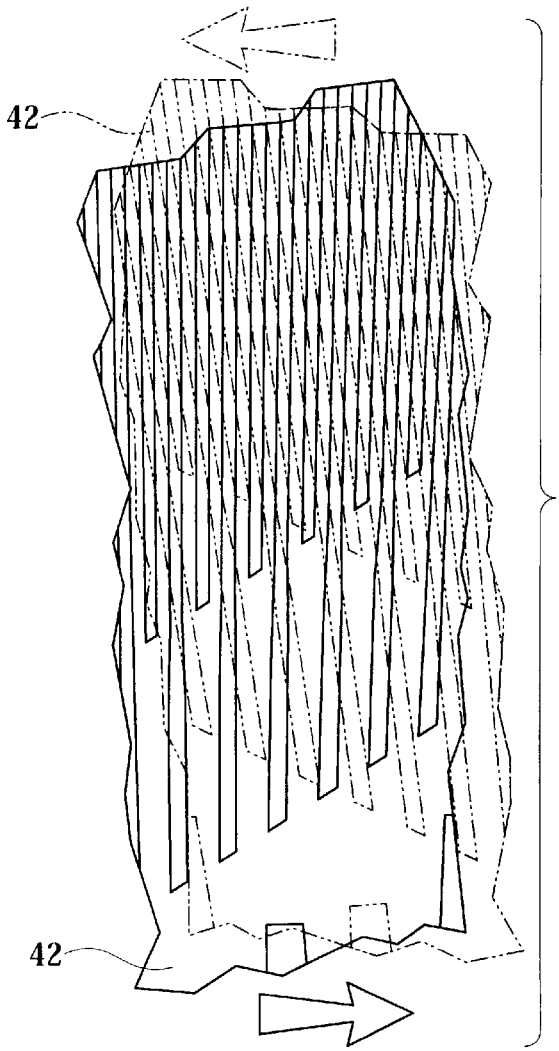
FIG. 11 is a fragmentary superposed view of two opposed refiner discs of this invention.

FIG. 11 depicts a pair of opposed refiner discs 42 of this invention in operation. The refiner 20 utilizing the refiner discs 42 of the invention is used to refine the fiber of a stock material in a more efficient manner. Examples of fiber that can be refined using the refiner discs 42 include wood fiber, recycled paper fiber, reject fiber, cotton, cloth, and rag. The refiner 20 of the invention may be utilized to refine any type of fiber used in papermaking and other related fiber products. Examples of disc refiners 20 for which the refiner disc 42 are well suited include disc refiners having only a single opposed disc annulus arrangement, counter rotating refiner arrangements, dual or double disc or twin refiners, or any other type of disc refiner.

The discs 42 face each other and are spaced apart by a gap that can vary between 0 inches (0 mm) and 0.5 inches (12.7 mm). Typically, the gap is between about 0.005 inches (0.127 mm) and about 0.125 inches (3.175 mm). Preferably, the gap between the discs 42 decreases in a radial outward direction. One of the discs 42 is rotated relative to the other of the discs 42 at a rotational speed of between 1,000 revolutions per minute and 2,500 revolutions per minute. If desired, both opposed discs 42 can be rotated at the same time in opposite directions.

Stock carrying fiber is introduced into the gap between the discs 42 from adjacent the inner radial edge 66 of both discs 42. Initially, the stock flows radially inwardly into the breaker bar section, zone E, where it is radially outwardly accelerated by the breaker bars 76. The accelerated stock enters the infeed zone, zone D, where the stock flows in the grooves between the infeed bars 74 in a direction generally parallel to the grooves 62 in the primary refining zone, zone C.

The stock continues to flow in the same radial outward direction when it enters the primary refining zone, zone C, where the fibers are cut and ground between the bars 58 of the opposed discs 42 fibrillating them. Where the disc is equipped with dams, the stock flows axially around the dams 70 and 72 into the gap between the discs helping to increase fibrillation, advantageously minimize, and preferably prevent the occurrence of shives.

The direction of the stock flow is altered when it enters zone B, a refining zone where fibrillation also takes place. By the direction of each groove 62 changing from zone C to zone B, the momentum of the stock changes and at least some momentum is dissipated. As a result, the maximum amplitude of the load is reduced and the magnitude of any vibration during a load swing is advantageously lessened. Moreover, by reducing momentum, the fibers are retained longer, advantageously increasing fibrillation. By locating zone B near the radial periphery of the disc where angular acceleration of the stock is greatest, the impact on reducing momentum and angular acceleration is increased.

Where the disc 42 is equipped with zone A, the direction of the stock is further altered when it enters zone A. Further fibrillation also takes place in zone A. By imparting another direction change to the stock flow, angular momentum and acceleration is reduced which also reduces the maximum load and the magnitude of load swings. By locating zone A at the radial periphery of the disc where angular acceleration of the stock is greatest, the impact on reducing momentum and angular acceleration is greatest. For discs 42 equipped with zones A and B, stock leaving zone C flows in a zigzag direction reducing momentum, reducing load, reducing load swings, and reducing shives, while increasing residency time and increasing fibrillation.

Referring additionally to FIG. 12, when fields of opposing discs having bars parallel to each other begin to overlap, a pumping cycle occurs. Referring to FIG. 4, such is the case where both opposing fields have the same pattern of field, such as field I. During the pumping cycle, the load, $L_4$, on the refiner 20 decreases until a field having angled bars begins to overlap. Such is the case where one field has the pattern of field I and the opposing field has a different pattern, such as the pattern of field II. At this point, a holdback cycle occurs, causing the load to increase generally in the exemplary manner reflected by load curve, $L_3$.

Figure 2:
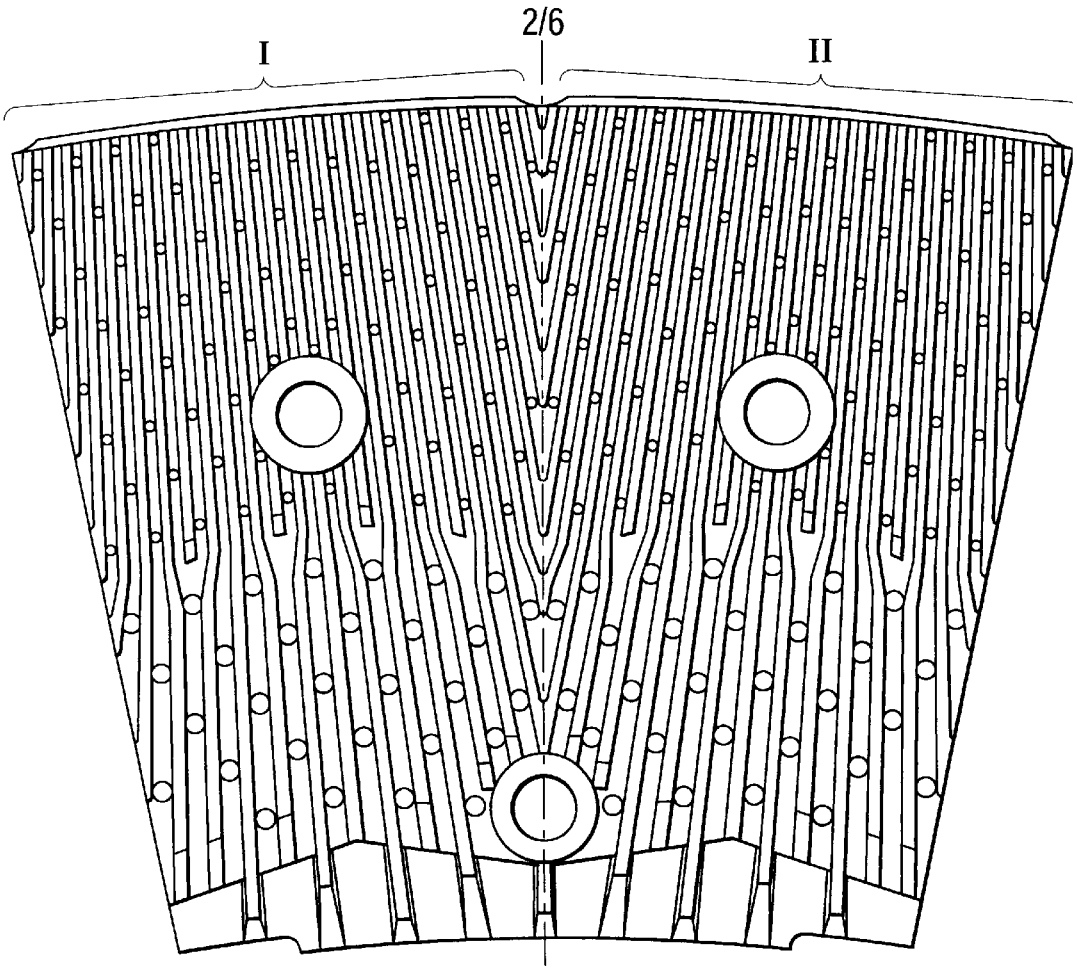
Fig.2 (PRIOR ART)
FIG. 2 is a front view of a prior art bi-directional refiner disc segment.
Figure 3:
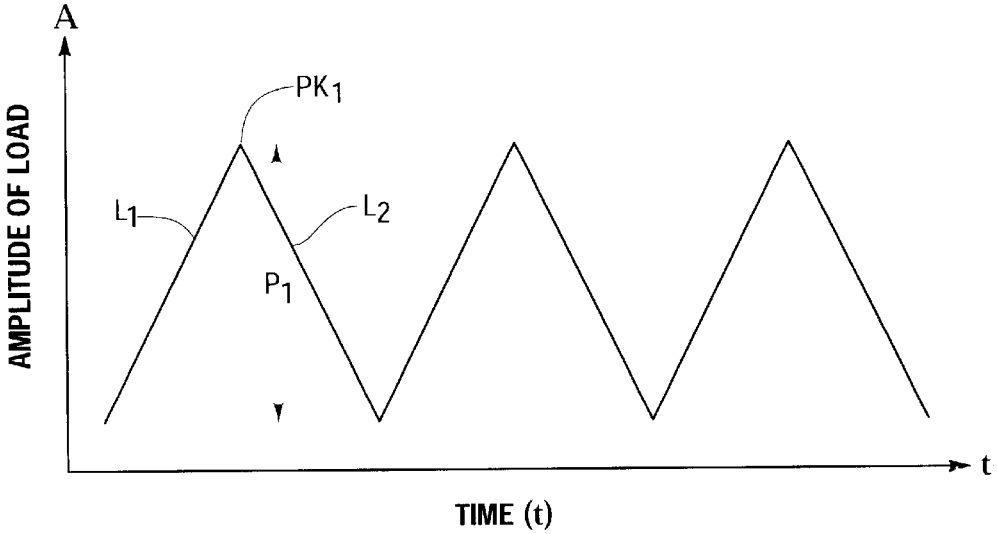
FIG. 3 is a graph of refiner load versus time of refiner operation using the prior art refiner disc segment.

FIG. 12 depicts a graph of load swings over time for a segmented refiner disc 42 having four fields per segment 54. As a result of each field encompassing a smaller angular extent that is roughly at least half the angular extent of the two fields of a conventional refiner disc segment (such as the segment shown in FIG. 2) having the same angular extent as segment 54, the amplitude, $P_2$, of each load swing is reduced at least 40%, dramatically reducing vibration. In addition, because the duration of each cycle of a complete load swing ($L_3$+$L_4$) is much shorter, the frequency of load swings is at least about twice that of a segment of the same angular extent having only two fields. Preferably, because the duration of each load cycle is so much shorter and because there is at least one flow direction altering zone radially outwardly of the primary refining zone, the amplitude of each load swing is advantageously reduced by 50% or more.

The refiner disc 42 (and segment 54) of this invention are designed to be able to be rotated in either direction or used with another disc that is rotated in either direction, preferably without any drop in efficiency, throughput, or pulp quality. Where the disc 42 is used as a bi-directional disc, disc life is significantly greater than that of a unidirectional disc. Disc life preferably is at least doubled as compared to a unidirectional refiner disc.

It is also to be understood that, although the foregoing description and drawings describe and illustrate in detail one or more embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A refiner for refining fiber in a stock slurry comprising:

a) a housing having an inlet for receiving the stock;

b) a rotor mounted for rotation about an axis within the housing;

c) a first mounting surface carried by the rotor and a second mounting surface opposing the first mounting surface;

d) a pair of annular refiner discs that each have a refining surface, with one of the refiner discs mounted to the first mounting surface and the other one of the refiner discs mounted to the second mounting surface such that the refining surface of the one of the refiner discs faces the refining surface of the other one of the refiner discs;

e) wherein at least one of the refiner discs is comprised of a plurality of segments, with the refining surface of at least one of the plurality of segments comprised of at least three radially extending fields of upraised refiner bars and grooves between pairs of adjacent refiner bars;

f) wherein the refining surface of each one of the fields is comprised of at least two refining zones of refiner bars and grooves and an infeed zone of infeed bars and grooves between adjacent infeed bars, wherein a first one of the refining zones is disposed radially inwardly of a second one of the refining zones and has a plurality of grooves that are wider than any groove in the second one of the refining zones, and the first one of the refining zones is disposed radially outwardly of the infeed zone; and g) wherein the first one of the refining zones and the second one of the refining zones both have a plurality of parallel grooves, with the plurality of parallel grooves in the first one of the refining zones being disposed at an angle relative to the plurality of parallel grooves in the second one of the refining zones.

2. The refiner of claim 1 wherein the plurality of parallel grooves in each one of the refining zones are generally straight and have a bend at a transition between the first one of the refining zones and the second one of the refining zones, and wherein each one of the parallel grooves is continuous and defined by a plurality of upraised refiner bars that extend continuously from within the first one of the refining zones to within the second one of the refining zones and have a bend at the transition that disposes the plurality of parallel grooves in the first one of the refining zones at an angle relative to the plurality of parallel grooves in the second one of the refining zones.

3. The refiner of claim 1 wherein there is a radially extending dividing line between each adjacent field of the at least one of the refiner disc segments, and the at least one of the refiner disc segments further comprises a generally triangular refining element in the refining surface that is disposed in line with each dividing line.

4. The refiner of claim 1 wherein the refiner disc is comprised of at least eighteen fields and is comprised of a plurality of the at least one of the refiner disc segments.

5. The refiner of claim 1 wherein there is a radially extending dividing line that divides each pair of adjacent fields of the at least one of the refiner disc segments, and the at least one of the refiner disc segments further comprises a chevron-shaped refining element in or on the refining surface that is disposed along one of the dividing lines.

6. The refiner of claim 1 wherein each field of the refiner disc is comprised of at least three generally annular and adjacent refining zones wherein (a) the angle of the plurality of parallel grooves in the first one of the refining zones is different than the angle of the plurality of parallel grooves in the the second one of the refining zones and the angle of the plurality of parallel grooves in the second one of the refining zones is different than the angle of a plurality of parallel grooves in a third one of the refining zones; (b) the plurality of parallel grooves in the first one of the refining zones connects with the plurality of parallel grooves in the second one of the refining zones and the plurality of parallel grooves in the second one of the refining zones connects with the plurality of parallel grooves in the third one of the refining zones; and (c) the direction of flow of stock is altered a first time when the stock passes from the first one of the refining zones to the second one of the refining zones and the direction of flow of stock is altered a second time when the stock passes from the second one of the refining zones to the third one of the refining zones.

7. The refiner of claim 6 wherein the grooves of the plurality of pairs parallel grooves in the first, second and third refining zones are each defined by a pair of zig-zag shaped refiner bars that extend continuously from the first one of the refining zones to the third one of the refining zones.

8. The refiner of claim 6 wherein each one of the plurality of parallel grooves in each one of the first, second and third one of the refining zones are generally straight, wherein there is a first bend connecting each one of the plurality of the parallel grooves in the first one of the refining zones and one of the plurality of the parallel grooves in the second one of the refining zones at a first transition between the first one of the refining zones and the second one of the refining zones and a second bend between each one of the plurality of the parallel grooves in the second one of the refining zones and one of the plurality of the parallel grooves in the third one of the refining zones at a second transition between the second one of the refining zones and the third one of the refining zones.

9. The refiner of claim 1 wherein the refining surface of the refiner disc comprises:

(1) a curved inner radial edge and a curved outer radial edge;

(2) an annularly extending breaker bar zone disposed along the inner radial edge radially inwardly of the infeed zone, the breaker bar zone comprised of a plurality of angularly spaced apart breaker bars;

(3) wherein the infeed zone comprises an annularly extending infeed zone disposed radially outwardly of the breaker bar zone, wherein each infeed bar is wider than any one of the refiner bars in the first one of the refining zones and the spacing between each adjacent pair of infeed bars defines an infeed groove that is wider than any one of the refining grooves in the first one of the refining grooves;

(4) wherein the second one of the refining zones comprises an annularly extending refining zone disposed radially outwardly of and adjacent to the first one of the refining zones, the second one of the refining zones comprised of refiner bars that are each acutely angled relative to radial; and (5) further comprising a third one of the refining zones that is an annularly extending refining zone disposed radially outwardly of the second one of the refining zones, the third one of the refining zones comprised of refiner bars that are each angled relative to the refiner bars in the second one of the refining zones and that are each acutely angled relative to radial.

10. The refiner of claim 9 further comprising a fourth one of the refining zones that is an annularly extending refining zone disposed along the outer peripheral edge and radially outwardly of the third one of the refining zones, the fourth one of the refining zones comprised of refiner bars that are each angled relative to the bars in the third one of the refining zones and that are each acutely angled relative to radial.

11. The refiner of claim 10 wherein the refiner bars in the fourth annularly extending refining zone are acutely angled in an opposite direction relative to the angle of the refiner bars in the second one of the refining zones.

12. The refiner of claim 11 wherein the refiner bars in the second one of the refining zones, the refiner bars in the third one of the refining zones, and the refiner bars in the fourth one of the refining zones form a zigzag pattern.

13. The refiner of claim 9 further comprising a plurality of radially spaced apart and annularly extending rows of dams in the refining grooves in the second one of the refining zones.

14. The refiner of claim 13 wherein one of the rows comprises at least one row of subsurface dams and another of the rows comprises at least one row of surface dams.

15. The refiner of claim 14 wherein there is one row of the subsurface dams that is located radially inwardly of one row of the surface dams.

16. The refiner of claim 14 wherein one of the rows of subsurface dams is arranged in a vee-shape and one of the rows of the surface dams is arranged in a vee-shape.

17. The refiner of claim 1 wherein the refiner disc has at least twelve of the fields and each of the fields encompasses an angular extent no greater than about 30° for reducing a maximum amplitude of a load placed on a refiner during a swing in loading.

18. The refiner of claim 1 wherein each one of the grooves of the plurality of parallel grooves in the first one of the refining zones is defined by a plurality of adjacent, parallel and straight refiner bars, wherein each one of the grooves of the plurality of parallel grooves in the second one of the refining zones is defined by a plurality of adjacent, parallel and straight refiner bars that connect with the plurality of adjacent, parallel and straight refiner bars in the first one of the refining zones, and wherein each one of the plurality of adjacent, parallel, and straight refiner bars in the first refining zone are disposed at an angle relative to each one of the plurality of adjacent, parallel, and straight refiner bars in the second refining zone defining a bend where each one of the plurality of parallel grooves in the first one of the refining zones connects to one of the plurality of parallel grooves in the second one of the refining zones.

19. A refiner disc for refining fiber in a stock slurry in a rotary disc refiner, the refiner disc comprising:

(a) a refining surface with at least twelve radial fields 1) that each have a pattern of upraised refiner bars defining grooves therebetween that includes a plurality of pairs of parallel refiner bars, 2) that each encompasses an angular extent no greater than 30°, and 3) that each have at least three annularly extending refining zones; and (b) wherein each one of the plurality of pairs of parallel refiner bars 1) is uninterrupted, 2) extends into each one of the at least three annularly extending refining zones, 3) has a portion in each one of the at least three annularly extending refining zones that is straight, and 4) has a zig-zag configuration; and (c) wherein the pattern of refiner bars in one of the fields is a mirror of the pattern of refiner bars in an adjacent one of the fields.

20. The refiner disc of claim 19 wherein one of the at least three annularly extending refining zones of each field comprises a primary refining zone that is larger than every other one of the at least three annularly extending refining zones.

21. The refiner disc of claim 20 wherein at least two of the at least three annularly extending refining zones of each field are disposed radially outwardly of the primary refining zone.

22. The refiner disc of claim 20 wherein the primary refining zone of each field further comprising a row of subsurface dams that is disposed radially inwardly of a row of surface dams.

23. The refiner disc of claim 19 wherein each one of the plurality of pairs of parallel refiner bars in a first one of the at least three annularly extending refining zones is disposed at an angle relative to each one of the plurality of pairs of parallel refiner bars in a second one of the at least three annularly extending refining zones and each one of the plurality of pairs of parallel refiner bars in the second one of the at least three annularly extending refining zones is disposed at an angle relative to each one of the plurality of pairs of parallel refiner bars in a third one of the at least three annularly extending refining zones.

24. A refiner disc segment for refining fiber in a stock slurry in a rotary disc refiner, the refiner disc segment having an axial refining surface comprising:

a) a plurality of spaced apart refiner bars with the refiner bars grouped into at least four radial fields that each have an angular extent that is no greater than 30° and that each have a pattern of the refiner bars;

b) wherein each one of the fields has 1) a first annularly extending refining zone of refiner bars defining grooves therebetween comprised of a first pair of parallel refiner bars, and 2) a second annularly extending refiner zone of refiner bars defining grooves therebetween, the second annularly extending refiner zone disposed radially outwardly of the first annularly extending refiner zone, the second annularly extending refiner zone comprised of a second air of parallel refiner bars with one of the refiner bars of the first pair of refiner bars connected to one of the refiner bars of the second pair of refiner bars and disposed at an angle relative thereto and the other one of the refiner bars of the first pair of refiner bars connected to the other one of the refiner bars of the second pair and disposed at an angle relative thereto; and c) wherein the pattern of refiner bars in one of the fields is mirrored with the pattern of refiner bars in each adjacent one of the fields.

25. The refiner disc segment of claim 24 wherein the first pair of parallel refiner bars and the second pair of parallel refiner bars are acutely angled relative to an adjacent radial line that separates adjacent fields.

26. The refiner disc segment of claim 24 wherein one of the first annularly extending refining zone comprises a primary refining zone that is larger than the second annularly extending refining zone.

27. The refiner disc segment of claim 24 further comprising a third annularly extending refining zone of refiner bars defining grooves therebetween, the third annularly extending refiner zone disposed radially outwardly of the second annularly extending refining zone and comprised of a third pair of parallel refiner bars with one of the refiner bars of the third pair connected to one of the refiner bars of the second pair of refiner bars and disposed at an angle relative thereto and the other one of the refiner bars of the third pair of refiner bars connected to the other one of the refiner bars of the second pair of refiner bars and disposed at an angle relative thereto.

28. The refiner disc segment of claim 27 wherein the second pair of the refiner bars and the third pair of the refiner bars form a zig-zag configuration.

29. The refiner disc segment of claim 27 wherein (a) the first pair of refiner bars is acutely angled relative to an adjacent radial line that separates adjacent fields and has an angle of no greater than about 20° relative to the adjacent radial line, (b) the second pair of refiner bars is acutely angled relative to the adjacent radial line and has an angle no greater than 45°, and (c) the third pair of refiner bars is acutely angled relative to the adjacent radial line and has an angle no greater than 60°.

30. The refiner disc segment of claim 27 wherein the first annularly extending refining zone comprises a primary refining zone that is larger than every other one of the annularly extending refining zones.

31. The refiner disc segment of claim 30 wherein the primary refining zone further comprises a pair of rows of dams.

32. The refiner disc segment of claim 31 wherein the second annularly extending refining zone and the third annularly extending refining zone both have no dams.

33. A refiner disc segment for refining fiber in a stock slurry in a rotary disc refiner, the refiner disc segment comprising:

a) an outer periphery;

b) an inner periphery;

c) a refining surface comprised of a plurality of spaced apart refiner bars disposed at an angle relative to radial with the refiner bars grouped into at least four radial fields that each have an angular extent that is no greater than 30°; and d) wherein each of the fields has 1) an annularly extending primary refining zone comprised of at least one refiner bar disposed at an angle relative to a radial line separating adjacent fields, 2) a second annularly extending refining zone disposed radially outwardly of the annularly extending primary refining zone, the second annularly extending refining zone having at least one refiner bar connected to the at least one refiner bar of the annularly extending primary refining zone and disposed at an angle relative to the at least one refiner bar of the annularly extending primary refining zone, 3) an annularly extending infeed zone disposed radially inwardly of the annularly extending primary refining zone, the annularly extending infeed zone having at least one infeed bar that is wider than the at least one refiner bar of the annularly extending primary refining zone, and 4) an annularly extending breaker bar zone disposed radially inwardly of the inwardly extending infeed zone and disposed adjacent the inner periphery, the annularly extending breaker bar zone including at least one generally radially extending breaker bar that is wider than the at least one infeed bar.

34. The refiner disc segment of claim 33 wherein each radial field is comprised of a pattern of upraised refiner bars and the pattern of refiner bars in one of the fields is mirrored with the pattern of refiner bars in each adjacent one of the fields.

35. The refiner disc segment of claim 33 wherein the primary refining zone comprised of a plurality of grooves defined between adjacent refiner bars and further comprising a subsurface dam in at least one of the grooves and a surface dam in the at least one of the grooves wherein the subsurface dam is disposed radially inwardly of the surface dam.

36. The refiner disc segment of claim 35 wherein the primary refining zone comprises a row of the subsurface dams and a row of surface dams located radially outwardly of the row of subsurface dams.

37. The refiner disc segment of claim 36 wherein no refining zone other than the primary refining zone has a dam.

38. The refiner disc segment of claim 33 further comprising a third annularly extending refining zone disposed radially outwardly of the second annularly extending refining zone, the third annularly extending refining zone having at least one refiner bar that is connected to the at least one refiner bar of the second annularly extending refining zone, and disposed at an angle relative to the at least one refiner bar of the second annularly extending refining zone.

39. The refiner disc segment of claim 38 wherein each at least one refiner bar of the second annularly extending refining zone and each at least one refiner bar of the third annularly extending refining zone form a zig-zag shape.

40. The refiner disc segment of claim 33 wherein each one of the radial fields further comprises a third annularly extending refining zone that is disposed radially outwardly of the second annularly extending refining zone.

41. The refiner disc segment of claim 40 wherein the third annularly extending refining zone has at least one refiner bar that is connected to the at least one refiner bar of the second annularly extending refining zone and disposed at an angle relative to the at least one refiner bar of the second annularly extending refining zone.

42. The refiner disc segment of claim 41 wherein the connected refiner bars of the primary refining zone, the second annularly extending refining zone and the third annularly extending refining zone define a zig-zag configuration.

43. The refiner disc segment of claim 33 wherein each radial field has an angular extent of between 20° and 2°.

44. A method of refining a fiber in a stock slurry comprising:

a) providing a pair of opposed refiner disc that are each comprised of a plurality of refiner disc segments with each refiner disc segment comprised of at least a plurality of radial fields that each have a pattern of upraised bars divided into at least three annularly extending zones with one of the zones comprising an infeed zone having a plurality of upraised infeed bars that define infeed grooves therebetween, a primary refining zone disposed radially outwardly of the infeed zone and having a plurality of refiner bars disposed at an angle relative to radial and that define refiner grooves therebetween, a secondary refining zone having a plurality of refiner bars disposed at an angle to the refiner bars of the primary refining zone and which have refiner grooves therebetween disposed at angle relative to the refiner grooves in the primary refining zone and which are connected thereto, wherein each field has an angular extent of no greater than about 30°, and wherein the pattern of bars in one of the fields of each refiner disc segment is mirrored with the pattern of bars in an adjacent one of the fields of the same refiner disc segment;

b) rotating at least one of the refiner discs in one direction relative to the other one of the refiner discs;

c) introducing a fibrous stock slurry between the refiner discs;

d) directing a portion of the stock slurry through the infeed grooves toward the primary refining zone and into one of the grooves in the primary refining zone;

e) refining fiber in the stock slurry in the primary refining zone;

f) changing the direction of flow of the stock slurry as it enters the secondary refining zone when the one of the grooves changes its angle in the secondary refining zone; and g) refining fiber in the stock slurry in the secondary refining zone.

45. The method of claim 44 further comprising providing a third refining zone disposed radially outwardly of the secondary refining zone, the third refining zone comprised of a plurality of refiner grooves defining grooves therebetween at an angle relative to the grooves in the secondary refining zone, and after step g) the steps further comprising changing the direction of flow of the stock slurry as it enters the third refining zone and refining fiber in the stock slurry in the third refining zone.

46. The method of claim 44 further comprising providing a breaker bar zone disposed radially inwardly of the infeed zone, the breaker bar zone comprised of a plurality of generally radially extending upraised breaker bars, and during step c) the breaker bars accelerate flow of the stock slurry in a radially outward direction.

47. The method of claim 44 wherein in step b) at least one of the refiner discs is rotated in one direction relative to the other of the refiner disc for a first duration of time and then the at least one of the refiner discs is rotated in an opposite direction relative to the other one of the refiner discs for a second duration of time.

48. A refiner disc segment for refining fiber in a stock slurry in a rotary disc refiner, the refiner disc segment comprising:

e) a curved outer periphery;

f) a curved inner periphery;

g) a refining surface comprised of a plurality of spaced apart refiner bars with the refiner bars grouped into at least four radial fields; and h) wherein each of the fields has 1) an annularly extending primary refining zone comprised of at least one refiner bar disposed at an angle relative to a radial line separating adjacent fields, 2) a second annularly extending refining zone disposed radially outwardly of the annularly extending primary refining zone, the second annularly extending refining zone having at least one refiner bar connected to the at least one refiner bar of the annularly extending primary refining zone and disposed at an angle relative to the at least one refiner bar of the annularly extending primary refining zone, and 3) an annularly extending infeed zone disposed radially inwardly of the annularly extending primary refining zone, the annularly extending infeed zone having at least one infeed bar that is wider than the at least one refiner bar of the annularly extending primary refining zone, and wherein the at least one infeed bar is connected to the at least one refiner bar in the annularly extending primary refining zone.

49. The refiner disc segment of claim 48 further comprising an annularly extending breaker bar zone disposed radially inwardly of the annularly extending infeed zone and adjacent the inner periphery of the refiner disc segment, and wherein the annularly extending breaker bar zone includes at least one generally radially extending breaker bar that is wider than the at least one infeed bar.

50. The refiner disc segment of claim 48 wherein (a) the primary refining zone and the second annularly extending refining zone are each comprised of a plurality of the refiner bars defining a plurality of refiner grooves therebetween that each have a width and (b) the infeed refining zone has a plurality of the infeed bars defining a plurality of infeed grooves therebetween that each have a width greater than the width of one of the refiner grooves and that each communicate with one of the refiner grooves.

51. A refiner disc segment for a rotary disc refiner that refines a fibrous slurry, the refiner disc segment comprising:

(a) curved outer periphery;

(b) a curved inner periphery;

(c) a refining surface comprised of at least four truncated pie-shaped fields of upraised parallel bars with each field having a pattern of the bars that is mirrored with the pattern of bars of an adjacent field;

(d) wherein each one of the fields is comprised of a first annularly extending refining zone that includes a first plurality of pairs of upraised, parallel and straight refiner bars and a second annularly extending refining zone disposed outwardly of the first refining zone and which includes a second plurality of pairs of upraised, parallel and straight refiner bars that are disposed at an angle relative to the refiner bars of the first plurality of pairs of refiner bars and connected to the refiner bars of the first plurality of pairs of refiner bars defining a plurality of pairs of grooves therebetween that are continuous, uninterrupted and that extend from the first refining zone to the second refining zone that each have a first straight portion in the first annularly extending refining zone and a second straight portion in the second annularly extending refining zone that is disposed at an angle relative to the first portion.

52. The refiner disc segment of claim 51 further comprising an annularly extending infeed refining zone disposed radially inwardly of the first annularly extending refining zone, the annularly extending infeed refining zone having at least one infeed refiner bar that is wider than the at least one refiner bar of the first annularly extending refining zone, and wherein the at least one infeed bar is connected to the at least one refiner bar in the first annularly extending refining zone.

53. The refiner disc segment of claim 52 further comprising an annularly extending breaker bar zone disposed radially inwardly of the annularly extending infeed refining one, the annularly extending breaker bar zone having at least one breaker bar that is wider than the at least one infeed refiner bar of the annularly extending infeed refining zone.

54. The refiner disc segment of claim 51 further comprising a third annularly extending refining zone that includes a plurality of third pairs of upraised, parallel and straight refiner bars that are disposed at an angle relative to the refiner bars of the plurality of second pairs of refiner bars and connected to the refiner bars of the plurality of first pairs of refiner bars defining a plurality of pairs of grooves therebetween that are continuous, uninterrupted and that extend from the first refining zone to the second refining zone.

55. A refiner disc segment for a rotary disc refiner that refines a fibrous slurry, the refiner disc segment comprising:

(a) a curved outer periphery;

(b) a curved inner periphery;

(c) a refining surface comprised of at least four truncated pie-shaped fields of upraised refiner bars with each field (1) having a pattern of the refiner bars that is mirrored with the pattern of the refiner bars of each adjacent field and (2) encompassing an angular extent of no greater than about 30°; and (d) wherein each one of the fields is comprised of a first refining zone comprised of upraised, parallel and straight refiner bars, a second refining zone comprised of upraised, parallel and straight refiner bars that are disposed at an angle relative to the upraised, parallel and straight refiner bars in the first refining zone, and a third refining zone comprised of upraised, parallel and straight refiner bars that are disposed at an angle relative to the upraised, parallel and straight refiner bars in the second refining zone.

56. A refiner disc for a refiner that processes wood or fabric fiber in a stock slurry, the refiner disc comprising:

an annulus having a refining surface with at least sixteen radially extending fields of upraised, spaced apart and radially extending refiner bars defining grooves therebetween, with each field extending from adjacent an inner peripheral annulus edge to an outer peripheral annulus edge and each field comprised of a plurality of pairs of the refiner bars that extend continuously from adjacent an inner peripheral annular edge to an outer peripheral annulus edge; and wherein each field has at least three generally radially aligned refining zones, with the part of the plurality of pairs of refiner bars and grooves in each zone having an angle that is different than the angle of the part of the plurality of pairs of refiner bars and grooves in each adjacent zone such that each one of the plurality of refiner bars is of zig-zag construction.

* * * * *